US012201208B1

(12) United States Patent
Stubbs et al.

(10) Patent No.: US 12,201,208 B1
(45) Date of Patent: Jan. 21, 2025

(54) SHIELD SLING APPARATUS FOR SHIELD SUPPORT

(71) Applicants: John David Stubbs, Durham, NC (US); Patrick Bradshaw, League City, TX (US)

(72) Inventors: John David Stubbs, Durham, NC (US); Patrick Bradshaw, League City, TX (US)

( * ) Notice: Subject to any disclaimer, the term of this patent is extended or adjusted under 35 U.S.C. 154(b) by 0 days.

(21) Appl. No.: 18/897,731

(22) Filed: Sep. 26, 2024

Related U.S. Application Data

(60) Provisional application No. 63/565,741, filed on Mar. 15, 2024.

(51) Int. Cl.
*A45F 3/14* (2006.01)
*A44B 11/26* (2006.01)
*F41H 5/08* (2006.01)

(52) U.S. Cl.
CPC ..... *A45F 3/14* (2013.01); *A44B 11/266* (2013.01); *F41H 5/08* (2013.01)

(58) Field of Classification Search
CPC ..... F41H 5/08; A45F 3/14
USPC ..... 89/36.01, 36.05
See application file for complete search history.

(56) References Cited

U.S. PATENT DOCUMENTS

| | | | | | |
|---|---|---|---|---|---|
| 3,370,302 | A * | 2/1968 | Karlyn | F41H 5/08 | 2/2.5 |
| 4,674,394 | A * | 6/1987 | Martino | F41H 5/08 | 2/2.5 |
| 5,329,636 | A * | 7/1994 | Siddle | F41H 5/08 | 2/92 |
| 5,392,686 | A * | 2/1995 | Sankar | F41H 5/08 | 109/49.5 |
| 7,971,516 | B2 * | 7/2011 | Hogan | F41H 5/08 | 224/907 |
| 8,210,088 | B1 * | 7/2012 | Keyfauver | F41H 5/08 | 89/918 |
| 8,584,571 | B2 * | 11/2013 | Armellino, Jr. | F41H 5/08 | 89/36.01 |
| 8,671,820 | B1 * | 3/2014 | Keyfauver | F41H 5/08 | 89/918 |
| 10,584,943 | B2 * | 3/2020 | Armellino, Jr. | F41H 5/08 | |
| 10,835,795 | B1 * | 11/2020 | Wilson | A63B 69/26 | |
| 11,841,212 | B2 * | 12/2023 | Maguire | A45F 4/02 | |
| 2019/0145741 | A1 * | 5/2019 | Spransy | F41H 5/013 | 89/36.05 |
| 2023/0324150 | A1 * | 10/2023 | van Riel | F41H 5/08 | 89/36.01 |

* cited by examiner

*Primary Examiner* — Justin M Larson
(74) *Attorney, Agent, or Firm* — Kearney, McWilliams & Davis, PLLC; William Yarbrough

(57) ABSTRACT

A sling for use with a ballistic shield, wherein the sling may be fastened with a release buckle and tightened. Excess strap may be secured in a glide buckle and can be trimmed to fit. An optional security webbing loop adds stability against strap sliding. Ambidextrous buckles near the handle grip allow versatile connection and use. The shoulder strap hooks onto the lower strap, enhancing stability.

20 Claims, 7 Drawing Sheets

SHIELD SLING APPARATUS FOR SHIELD SUPPORT

FIELD OF THE DISCLOSURE

The present invention relates to a shield sling apparatus usable with a ballistic shield, generally. Specifically, the shield sling is comprised of natural or synthetic material that provides functional support and ambidextrous use to support the weight of a ballistic shield 'in use' whereby the shield user may distribute the ballistic shield's weight away from the user's hand and arm and to user's back and shoulders for lengthening periods of support and use.

BACKGROUND OF THE DISCLOSURE

Using a ballistic shield, while undoubtedly a crucial piece of protective equipment for law enforcement, military personnel, and security professionals, presents a myriad of challenges and difficulties in various operational scenarios, due primarily to size and weight of the shield as well as the ability to successfully manage both over any extended length of time.

Due to the sheer weight and size of ballistic shields, depending on coverage areas and materials, the ability to secure and manage any such shield can be a significant hindrance especially over any length of extended use. These shields are designed to withstand high-velocity impacts from firearms, which often means they are constructed from heavy materials such as hardened steel or ceramic composites. Carrying and maneuvering such weight, particularly for long periods, can quickly lead to fatigue and decreased mobility, compromising the user's effective utilization of a shield in dynamic situations and environments.

For operational support with shield use, a sling has various benefits allowing users to provide adequate support in carrying a shield without fully shouldering the full distribution of weight in the hand, arm and elbow. For instance, a member of law enforcement carrying a shield who cannot fully lift, operate and/or support the weight of the shield over a period of extended use. This same user also may not be able to effectively manipulate a shield during use, due to shield weight and fatigue which create issues of effective utilization in certain situations (e.g., providing hindrances to getting into a protective stance to shield oneself from harm, manipulating a shield for maximum coverage or holding a shield for protected advancement) thereby greatly diminishing the inherent utility of a ballistic shield in terms of protection and thereby jeopardizing the life of the officer, other officers and/or innocent civilians.

In addition to weight distribution, attaching a modular accessory to the shoulder strap provides additional utility during tactical operations. This modular accessory can accept a variety of critical tools, including a communications device, first aid equipment, ammunition, or lighting, or a combination thereof. Using the accessory in conjunction with the ballistic shield offers enhanced operational efficiency, allowing the user to remain hands-free while ensuring necessary tools are readily available.

Such provisions are necessary and critically important to not only protect oneself but also others. What is needed is an apparatus for law enforcement, as well as other military personnel, to carry, maintain and properly utilize a ballistic shield, provide the ability to manipulate (i.e., adjust and readjust shoulder straps), as well as quickly release the shield to provide the most effective use, coverage, and sufficient protection from harm.

While certain advancements have been made to overcome the inadequacies of proper manipulation and maintenance of a ballistic shield in highly dynamic situations, it remains evident that considerable failings remain in shield maintenance and operation, especially over time, while ensuring peak functionality across an engagement or situation. It is in light of the above shortcomings, inventors seek to remediate the deficiencies of previous failed attempts to address the long felt need for a precisely placed, adjustable support strap and system, and method of provision thereof, that adequately serves the need of law enforcement and military applications alike.

While inventors have set forth the best mode or modes contemplated of carrying out the present invention known to the inventor such to enable a person skilled in the art to practice the present invention, the preferred embodiments are, however, not intended to be limited to the present disclosure, but, on the contrary, are included in a non-limiting sense apt to alterations and modifications, based primarily materials, sizes and placement points falling within the scope and spirit of the disclosure as provided.

SUMMARY

Embodiments of the disclosure pertain to a sling that may comprise any of the following: a lower strap; a layer of webbing; a release buckle; a glide buckle; a male (insertable) buckle; a female (receiving) buckle; a tab loop engaged onto at least a portion of the layer of webbing, thereby forming a strap connection; a shoulder strap; a hook, or some combination thereof, providing a means to effectively manipulate and maintain a ballistic shield.

The lower (support) strap may be equipped with a release buckle for secure tightening and a first buckle and second buckle (male-to-female or female-to-male) for excess strap management.

The attachment to the shield's handle grip may feature a release buckle, and/or a first buckle, and second buckle (as described above). The connection of these components may facilitate attachment to the shield's carry handle grip enabling orientation and/or reorientation of the strap from one shoulder to the other (and back) and/or ambidextrous usage.

The shoulder strap may include a layer of webbing configured with a release buckle and/or a hook to connect to a tab loop at the points of connection to the ballistic shield superiorly at the hand grip or inferiorly to the lower strap.

Other embodiments pertain to a ballistic shield sling strap that may additionally provide a pad on the shoulder strap to provide comfort and/or where said strap may serve as a point of attachment for storage for a medic kit, additional ammunition, equipment storage, replacement webbing and the like.

These and other embodiments, features and advantages will be apparent in the following detailed description and drawings.

BRIEF DESCRIPTION OF THE DRAWINGS

A full understanding of embodiments disclosed herein may be obtained from the detailed description of the disclosure presented herein below, and the accompanying diagrams, which are given by way of illustration only and are not intended to be limitative of the present embodiments, and wherein.

Figure 1:
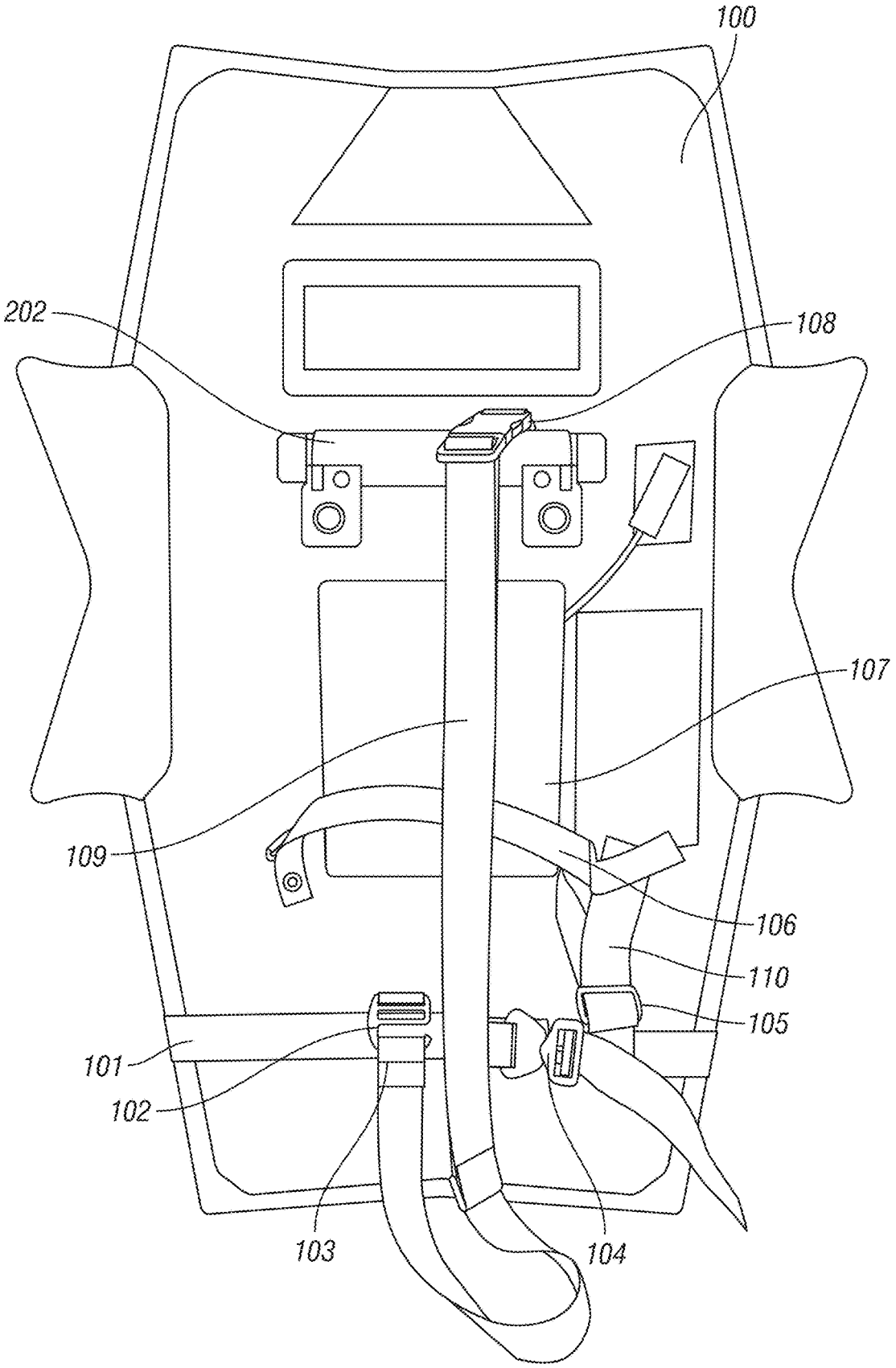
FIG. 1 illustrates a rearward view of the sling that is the present invention with a lower strap wrapped around the lower part of a ballistic shield and connected, by a lower connection point, to an upper attachment point connected over a handle grip being attached to the contact point between the shield and handle grip thus creating the attached sling that is the present invention, in accordance with embodiments disclosed herein.

It should, however, be understood that the above figures and summary are not intended to limit the invention to the embodiments disclosed, but on the contrary, the invention disclosure may be intended to cover all modifications, alternatives and equivalents falling within the spirit and scope of the invention as defined within the claim's broadest reasonable interpretation consistent with the specification.

DETAILED DESCRIPTION

Herein disclosed are novel apparatuses, units, systems, and methods that pertain to a ballistic shield sling, construction, use and manufacture thereof, details of which are described herein.

Embodiments of the present disclosure are described in detail with reference to the accompanying figures. In the following disclosure claims, the terms "including" and "comprising" are used in an open-ended fashion, such as to mean, for example, "including, but not limited to . . . " While the disclosure may be described with reference to relevant apparatuses, systems, and methods, it should be understood that the disclosure may not be limited to the specific embodiments shown or described. Rather, one skilled in the art will appreciate that a variety of configurations may be implemented in accordance with embodiments herein.

Although not necessary, like elements in the various figures may be denoted by reference numerals for consistency and ease of understanding. Numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are intended for illustrative purposes only, and not to limit the disclosure.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements may not be meant to limit the interaction to direct interaction between the elements and may also include indirect interaction between the elements described.

The term "lower strap" as used herein may refer to a connection to the shield's lower region (i.e., lower third or half) via a shield strap wherein the present invention that is a shield sling support strap may be connected by way of a release buckle or buckles, a hook mechanism or mechanisms, or a combination thereof.

The term "male buckle" as used herein may refer to the portion of the sling that connects and disconnects to or into a female buckle.

The term "female buckle" as used herein may refer to the portion of the sling that receives and latches a male buckle to ensure sling securement, proper operation, securement and stability.

The term "buckle connection" as used herein may refer to the engagement or connecting structure between a male and female buckle which may be slidable, connected, reversibly connected, reversibly securable and releasable.

The term "release buckle" as used herein may refer to a portion of the sling strap that connects said lower strap at the bottom portion of a shield, defined supra, a connection at the hand grip, or a combination thereof.

The term "glide buckle" as used herein may refer to three horizontal bars wherein a center bar may be used to adjust the length of webbing of the ballistic shield strap for security at a lower strap, along the length of the sling strap, at a hand grip, or a combination thereof.

The term "sling" as used herein may refer to a sling, strap or the apparatus in its entirety inclusive of buckles, connections and/or a combination thereof.

The term "arm sling" or "elbow rest" or "elbow support member" as used herein may refer to a receiving "loop", support strap or other receptacle on a shield where its user can support/rest their forearm and elbow region when holding (as a support) and/or for maneuvering the shield.

The term "padding" as used herein may refer to any material on a ballistic shield where its user can lean and support the forearm from friction of the shield and/or a cushioned support at any point along the vertical strap itself, but primarily at areas interfacing the shoulders and back.

The term "handle grip", "handle bar," or "grip" refers to an attached bar portion of the shield that allows its user to lift, hold, and maneuver the weight of the shield.

The term "connective point" or "attachment point" refers to the physical point where two or more items meet.

The term "ballistic shield" and "shield" may be used interchangeably to refer to the shield in its entirety inclusive of elbow support and handle grip.

In the present embodiment, as defined by FIGS. 1-11, the device and apparatus that is the present invention is shown and having figures enumerated thereto. Turning first to FIG. 1, a male and female buckle attachment point 108 connects a shoulder strap 109 (as provided in FIG. 3 and FIG. 7) over a handle grip 202 (shown in greater detail in FIG. 2) whereby the shoulder strap 109 descends to connect to a lower strap 101 by way of a hook 102 and a sewn tab loop 103 providing a connection point thereto. The lower strap 101 may be connected via release buckle 104 around the lower circumference of ballistic shield 100, and in the lower third, of said ballistic shield 100 wherein glide buckle 105 may be used to secure and/or tighten lower strap 101 via connection with arm sling/shoulder support 106.

Figure 4:
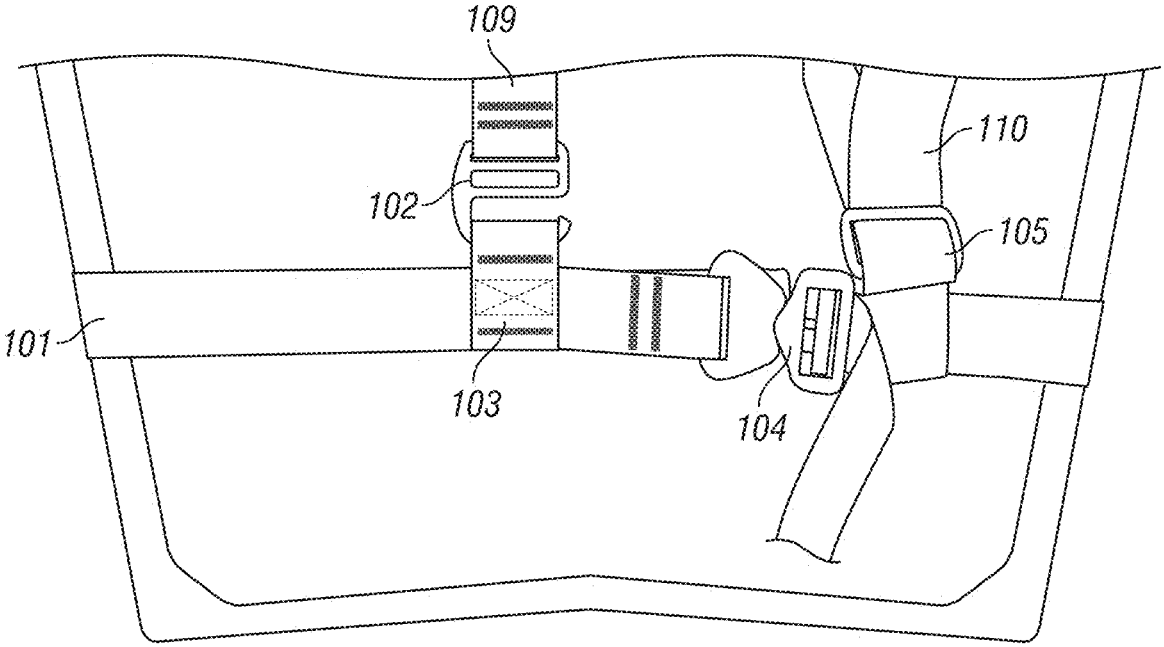
FIG. 4 illustrates a rear view of a lower strap attachment with a sewn tab loop connected to a shoulder strap by a hook and a release buckle, a release buckle for engaging and disengaging, and a glide buckle and equipped with a tightening strap for tightening and loosening.
Figure 5:
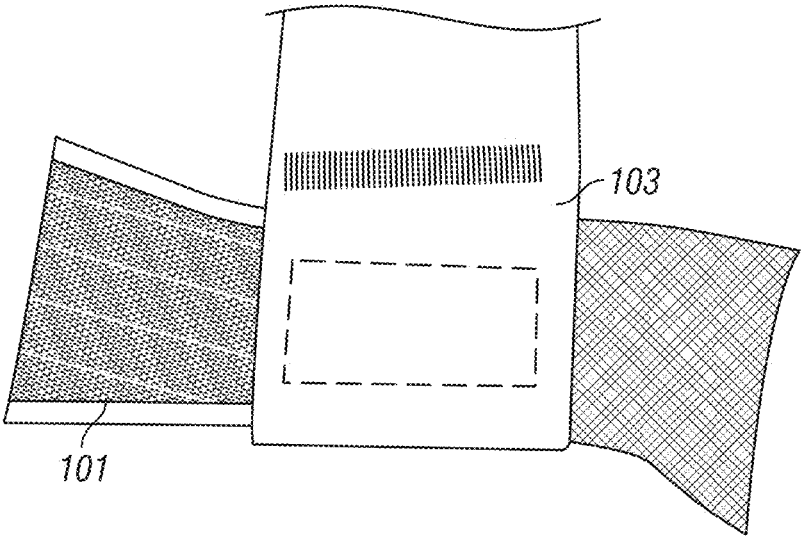
FIG. 5 illustrates a rearview of a lower strap and sewn tab loop attachment point.
Figure 6:
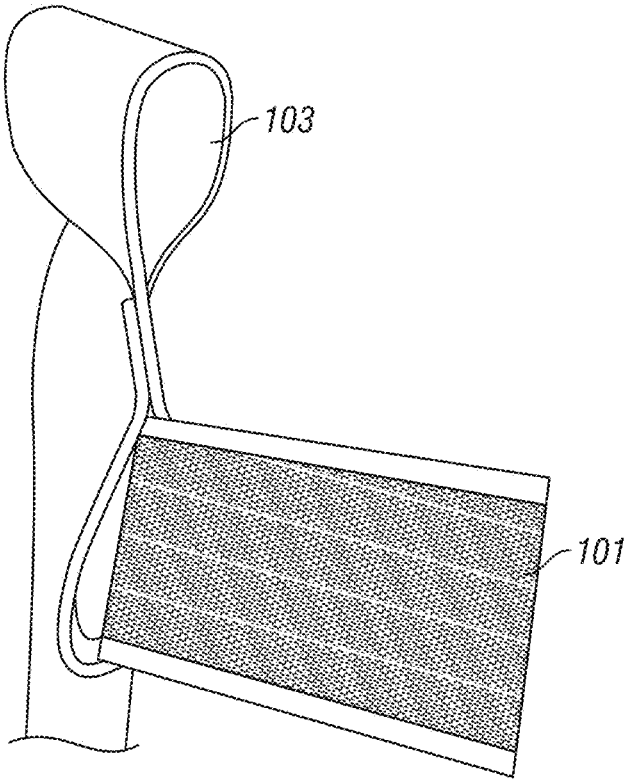
FIG. 6 displays a sideview of a lower strap and sewn tab loop attachment point in which the loop at the top of a sewn tab loop is utilized to hook a shoulder strap.
Figure 8:
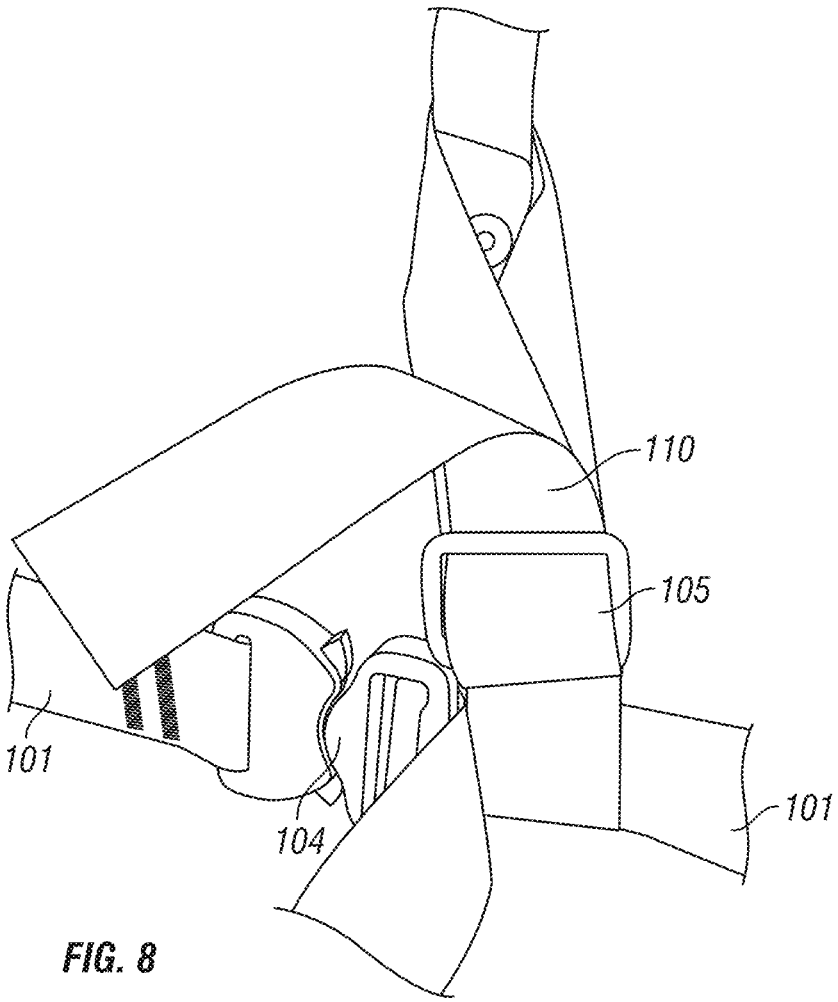
FIG. 8 shows an overview perspective of a lower strap, release buckle, glide buckle and tightening strap for a glide buckle.
Figure 9:
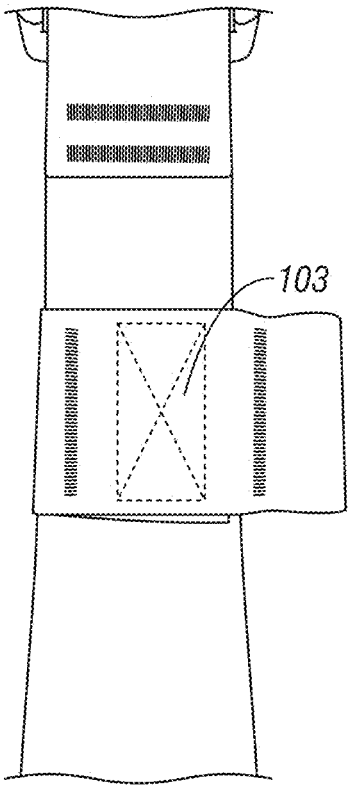
FIG. 9 displays a front view of a sewn tab loop webbing.
Figure 10:
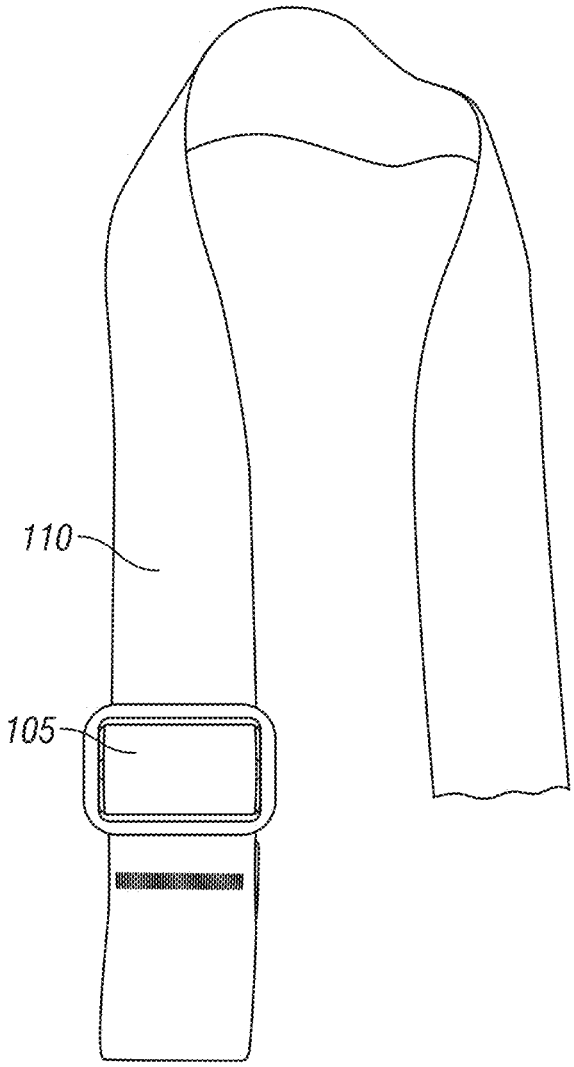
FIG. 10 shows a front view of a glide buckle and tightening strap.

As provided in FIG. 4, and in greater detail in FIG. 8, lower strap 101 is evidenced in a lower strap 101 front-facing (rearward ballistic shield 100) view wherein lower strap 101 is affixed about the circumference of the lower portion of the ballistic shield 100 as to provide adjustable support. A sewn tab loop 103 is attached about the circumference to the lower strap 101 whereby hook 102 (here shown as a reverse "E" hook) is attached through the sewn tab loop 103 to connect the shoulder strap 109 to the lower strap 101. The lower strap 101 is connected around the lower circumference of the ballistic shield 100 and can be disengaged by a release buckle 104 and/or tightened to the arm sling/shoulder support 106 by a glide buckle 105. It further to be noted that an additional release buckle or buckles and/or glide buckle or buckles may be placed along the length of the lower strap 101 as necessity and proclivity dictate.

Figure 11:
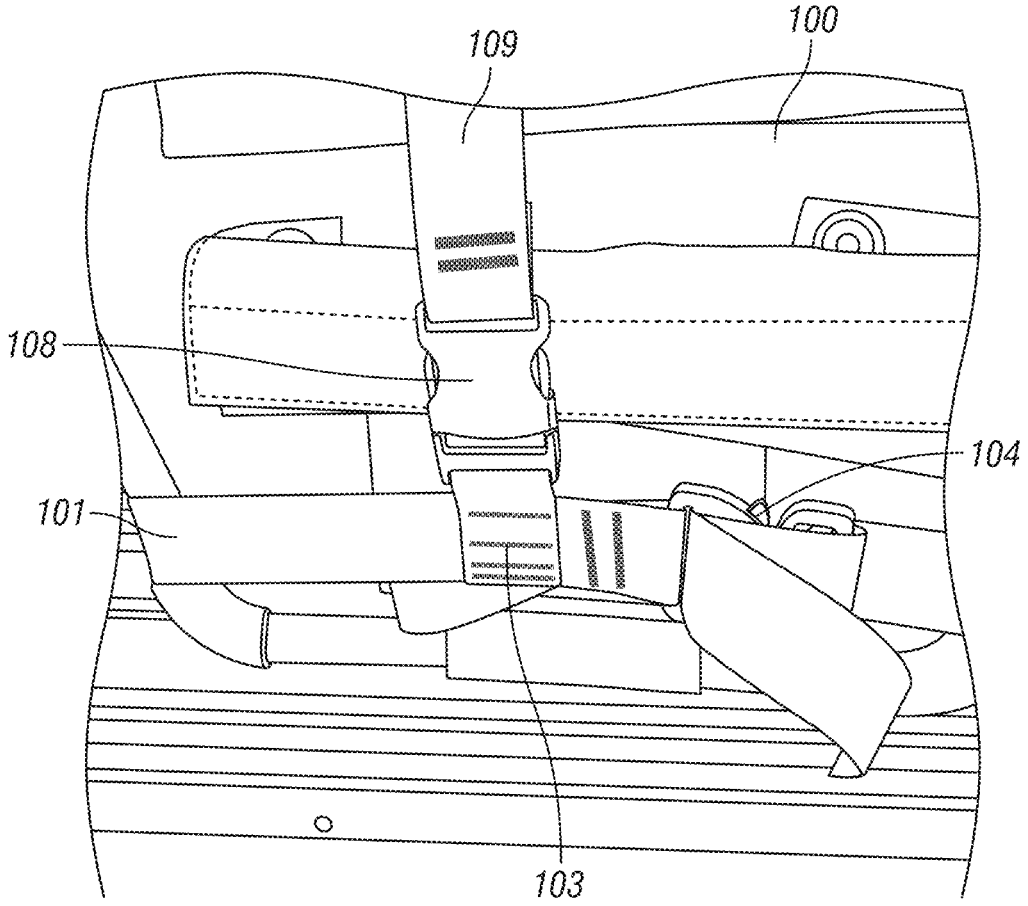
FIG. 11 displays another preferred embodiment of the shield whereby a lower strap and shoulder strap is connected by a male and female attachment point similar to FIG. 1.

In a preferred embodiment, as defined in FIG. 11 the hook 102 and sewn tab loop 103 connection may be a male and female buckle single attachment point 108.

In another embodiment, the lower strap 101 may be made of 50 inches of 1.5-inch-high strength webbing and one release buckle 104.

Figure 7:
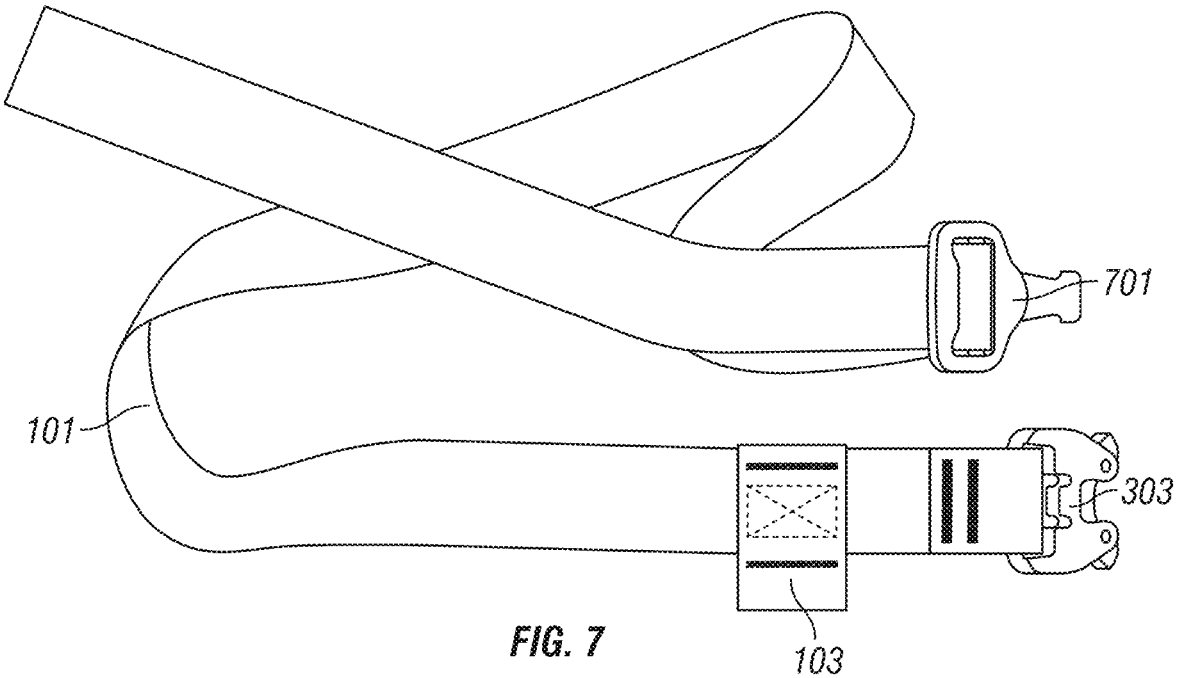
FIG. 7 shows a standalone view of a lower strap, sewn tab loop and release buckle.

In the present embodiment, as defined in FIG. 7, the lower strap 101 has a male insertable buckle 701 and a female receiving buckle 303 both used in conjunction to make an attachment point around the lower circumference of the shield 100 (Shown in FIG. 1).

In the present embodiment, as defined by FIG. 8, the release buckle 104 is equipped with an adjacent glide buckle 105 and tightening strap 110 for tightening and loosing of the lower strap 101 in relation to arm sling/shoulder support 106.

Figure 2:
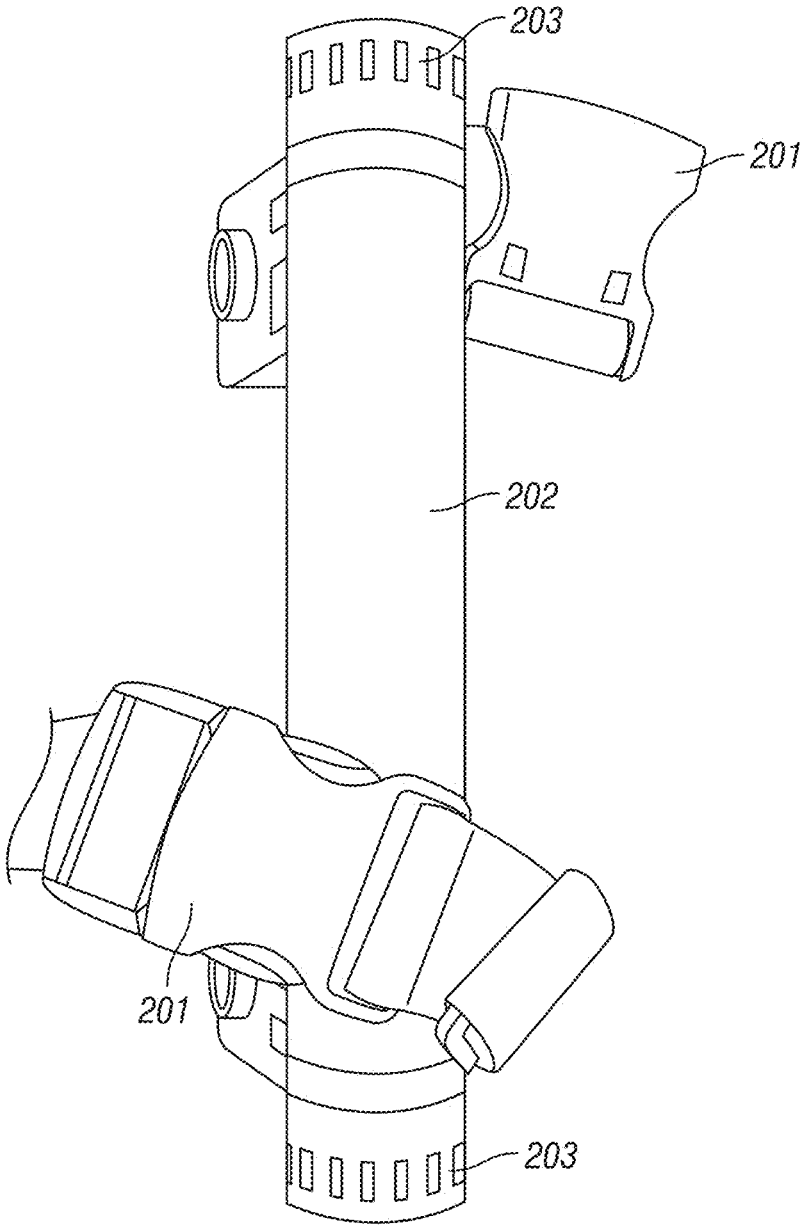
FIG. 2 illustrates an overview perspective of a handle grip displaying two points of attachment for strap connection of the shield sling of FIG. 1.
Figure 3:
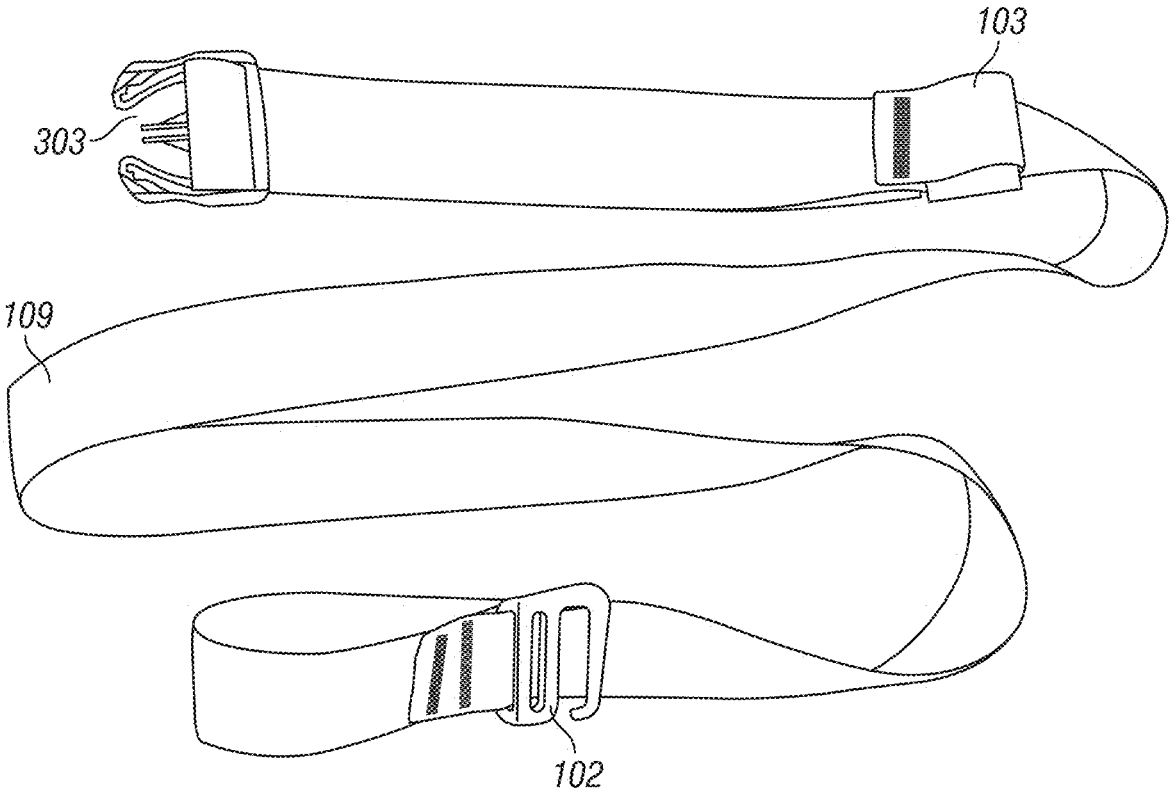
FIG. 3 shows a front view of a shoulder strap that connects to both the handle grip of FIG. 2 by way of a male insertable and sewn tab loop of a lower strap by way of a hook or male and female attachment point.

In the present embodiment, as defined in in FIG. 3, the shoulder strap 109 which is connected to the lower strap 101 by way of the hook 102 and sewn tab loop 103 has a male insertable buckle 303 utilized for a single attachment point over the handle grip 202 (see FIGS. 1-2).

In the present embodiment, as defined in FIG. 1, an elbow padding 107 may be attached to the rear of the shoulder strap 109, or at any point along portions of the shoulder strap 109 that contacts the user, to provide comfort and support. Such padding may be served to prevent stress and fatigue on the user's shoulder and back from the material webbing of the shoulder strap.

Referring now to FIG. 2, the handle grip 202 of the shield 100 provides a handle grip and shield connective point 203 that allows the for a dual (right and left sided) attachment point for ambidextrous use 201.

In operation, the sling itself is connected to ballistic shield 100 by a lower strap 101 by way of a release buckle 104 and adjusted by a plurality of glide buckles 105 and a tightening strap 110 which may be used to adjust the length and security of belt material running perpendicular to lower strap 101. The perpendicular portion of the sling provides a means of attachment to lower strap 101 whereby the weight realized in lower strap 101 is distributed from the lower portion of ballistic shield 100, through a right or left shoulder utilized perpendicular shoulder strap 109 (itself adhered or otherwise connected to handle grip 202). Whereas the weight of ballistic shield 101 is typically carried by the user via a "hand grip" or "hand-held" operation, effectuated from a largely perpendicular configuration of the user's arm with the user's elbow resting in elbow sling 106, forearm resting against padding 107 and user's first clenching handle grip 202, the current sling 10 allows for redistribution of the weight of the shield 100, starting at lower strap 101, traveling through the shoulder strap 109 and connecting, for sling terminus, weight distribution and control, at handle grip 202. And, while the majority of the weight of the shield 100 is distributed across the upper back and shoulders of the user, ballistic shield 100 may continue to provide additional weight management and necessary control through the placement of the elbow, forearm and hand traditionally utilized in addition to the present invention (i.e., elbow sling 106, padding 107 and handle grip 202) to alleviate the pressure of carrying the shield and allow for maximal maneuverability and ballistic shield 100 control.

In another embodiment, to secure the lower strap 101, the user may fasten the release buckle and tighten the lower strap 101. Once tightened, the extra length of the lower strap 101 may be threaded back over the release buckle 104 and through the main attachment. Users may elect to trim the extra length of the lower strap 101 to a specific length.

Preferred Embodiments

Embodiments herein provide for the shield sling apparatus including a lower strap with one or more release buckles and glide buckles for securement and adjustment. The handle grip features one or more release buckle attachments on either the first or second side, allowing for ambidextrous use. Additionally, the apparatus includes a male release buckle attached to the shoulder strap and a corresponding female release buckle attached to the handle grip, or vice versa, enabling reversible and secure engagement of the buckles.

Embodiments herein provide a shoulder strap padded section, which can either be movable or stationary, to provide comfort and evenly distribute the weight of the ballistic shield across the user's back and shoulders. Constructed from high-strength webbing material with a non-slip coating, the lower strap, shoulder strap, and release buckle mechanism straps are designed to support the full weight of the ballistic shield while inducing friction. Furthermore, a secondary strap may be included to connect the lower strap to the elbow support, providing additional positioning and securement via a glide buckle.

Embodiments herein provide for enhanced functionality, a shoulder strap may incorporate one or more glide buckles for fit adjustment, ensuring that the shield remains securely supported during dynamic movements. It may also feature a quick-adjust pull tab for rapid length changes, and an integrated elastic section in the lower strap allows for flexibility, shock absorption, and added comfort.

In a preferred embodiment, the shoulder strap may be made from 74 inches of 1.5-inch-wide material.

In a preferred embodiment, there may be an optional security strap that is, for example, roughly 23 inches long with a 2-inch sewn loop, attached to the lower strap.

However, it is contemplated that the security strap may be of shorter or longer lengths. To attach, the user may thread the lower strap through the loop or secure it to the shoulder strap using a glide buckle or any suitable attachment. This extra strap helps prevent the lower strap from slipping when the shield is placed on the ground.

In a preferred embodiment, there may be, for example, a tab loop, 6.5-inches in total length, sewn onto the webbing for the shoulder strap 103.

Embodiments herein may provide a reinforcement padding on the shoulder strap to provide comfort and prevent pressure on the shoulder and upper back.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim may be intended to mean that the subject element may be required, or alternatively, may not be required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection may not be limited by the description set out above but may be only limited by the claims which follow, that scope including all equivalents of the subject matter of the claims. Each and every claim may be incorporated into the specification as an embodiment of the present disclosure. Thus, the claims are a further description and are an addition to the preferred embodiments of the present disclosure. The inclusion or discussion of a reference may not be an admission that it may be prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A shield sling apparatus for the securement and manipulation of a ballistic shield having a handle grip and an elbow support comprising: a lower strap, a shoulder strap and a handle grip attachment; said lower strap attached to an outer circumference of a lower portion of said shield; said lower strap comprised of a layered webbing; said lower strap having a release buckle or buckles, a glide buckle or buckles, and a tab loop; said release buckle or buckles being a quick release buckle having a male insert member and a female receiver member; said male insert member and female receiver member being reversibly connectable; said glide buckle or buckles being fixedly attached to said lower strap layered webbing; said tab loop engaged onto at least a portion of the layer webbing, thereby forming a connector for engaging a first end of said shoulder strap said shoulder strap running from said tab loop of the lower strap at said shoulder strap first end to e said handle grip attachment at a second end of said shoulder strap; and said handle grip attachment having a release buckle attached at a first or second side of said handle grip for attachment to said shoulder strap.

2. The apparatus of claim 1, wherein the lower strap has a plurality of release buckles and glide buckles for securement and adjustment.

3. The apparatus of claim 1, wherein said handle grip attachment has a plurality of release buckles for connection to a first and second handle grip side to facilitate ambidextrous use.

4. The apparatus of claim 1, comprising: a male release buckle member attached to the shoulder strap; and a corresponding female release buckle member attached to the handle grip of the ballistic shield, a female release buckle member attached to the shoulder strap and a male release buckle member attached to the handle grip, or a combination thereof, wherein the male and female buckles are configured for reversible and secure engagement.

5. The apparatus of claim 1, wherein the shoulder strap includes a padded section to provide comfort and distribute the weight of the ballistic shield evenly across a user's back and shoulders;

said padded section being moveable or stationary.

6. The apparatus of claim 1, wherein the lower strap, and shoulder strap are constructed from high-strength webbing material capable of supporting the full weight of the ballistic shield; said high-strength webbing material having a non-slip coating material to increase friction and enhance grip on the shield.

7. The apparatus of claim 1, further comprising a secondary strap between said lower strap and said elbow support for positioning and securing the lower strap, said secondary strap being attached to the lower strap using a glide buckle.

8. The apparatus of claim 1, wherein the shoulder strap includes one to a plurality of glide buckles positioned along its length for adjusting the fit and ensuring the ballistic shield remains securely supported during dynamic movement.

9. The apparatus of claim 8 wherein said glide buckle is a tri-glide slide made to receive a webbing tab and return said webbing tab in the opposite direction; said glide buckle used for tightening and loosening of said shoulder strap.

10. The apparatus of claim 1, wherein the shoulder strap includes a quick-adjust pull tab for rapid tightening or loosening of the shoulder strap, allowing the user to easily adjust the length of the shoulder strap with one hand while in use.

11. The apparatus of claim 1, further comprising an integrated elastic section in the lower strap to allow for slight stretching and flexibility to absorb shock and provide additional comfort during movement.

12. A method of using a shield sling apparatus for use and supporting the ballistic shield of claim 1, the method comprising: connecting the lower strap around the circumference of a lower portion of the ballistic shield; affixing the tab loop to said lower strap; connecting the first end of the shoulder strap to the tab loop of the lower strap; said first end of the shoulder strap connected to said loop tab via a connector; connecting said second end of the shoulder strap to said handle grip; said second end of the shoulder strap connected to said handle grip via a release buckle; securing the lower strap with a release buckle or buckles for loosening adjustment, tightening and releasing; connecting said second end of shoulder strap to said handle grip at said first or second side; adjusting a glide buckle or buckles on said shoulder strap for loosening, adjustment to length, tightening and releasing; and affixing a movable guide strap connecting said lower strap to said shield elbow support.

13. The method of claim 12, further comprising the step of reconnecting the shoulder strap from a first to a second handle grip end or a second to a first handle grip end, to be ambidextrous, allowing the shield sling apparatus to be worn on either the left or right shoulder of the user; and securing male and female buckles for reversible and secure engagement.

14. The method of claim 12, further comprising:

engaging a male buckle attached to the shoulder strap with a corresponding female buckle attached to the handle grip of the ballistic shield.

15. The method of claim 12, further comprising the step of positioning a padded section on the shoulder strap to distribute the weight of the ballistic shield evenly across the user's back and shoulders.

16. The method of claim 12, further comprising the step of securing a secondary strap around the lower strap and elbow support, wherein the secondary strap is attached to the lower strap or shoulder strap using a glide buckle.

17. The method of claim 12, further comprising the step of adjusting the fit of the shoulder strap using multiple glide buckles positioned along its length to ensure the ballistic shield remains securely supported during dynamic movement, adjustment, or tightening.

18. The method of claim 12, further comprising the steps of:

attaching a modular accessory to the shoulder strap;

using the accessory in conjunction with the ballistic shield for additional utility, such as accepting a communications device, first aid equipment, ammunition, lighting, or a combination thereof, during tactical operations.

19. The method of claim 12, further comprising a quick-detach pull tab on the shoulder strap for rapid disconnecting of the strap from the handle grip, lower strap, or both, allowing the user to quickly release the shield in emergency situations.

20. The method of claim 12, further comprising the step of utilizing a non-slip material coating on an interior surface of the lower strap to prevent movement of the lower strap against the ballistic shield.

* * * * *